United States Patent [19]

Golz

[11] Patent Number: 4,903,753

[45] Date of Patent: Feb. 27, 1990

[54] CASTING TECHNIQUE FOR LEAD STORAGE BATTERY GRIDS

[75] Inventor: Hans-Joachim Golz, Hanover, Fed. Rep. of Germany

[73] Assignee: Varta Batterie Aktiengesellschaft, Hanover, Fed. Rep. of Germany

[21] Appl. No.: 843,814

[22] Filed: Mar. 27, 1986

Related U.S. Application Data

[63] Continuation of Ser. No. 487,906, Apr. 22, 1983, abandoned.

[30] Foreign Application Priority Data

Mar. 5, 1982 [DE] Fed. Rep. of Germany ..... 3216432

[51] Int. Cl.[4] ..... B22D 27/04

[52] U.S. Cl. ..... 164/493; 164/492; 164/122; 164/338.1

[58] Field of Search ..... 164/122, 338.1, 47, 164/48, 492, 493, 498, 250.1, 513, DIG. 1, 499, 500; 249/135

[56] References Cited

U.S. PATENT DOCUMENTS

| | | | |
|---|---|---|---|
| 1,570,317 | 3/1926 | Eklind | 164/492 |
| 1,978,222 | 10/1934 | Otte | 164/48 |
| 2,045,576 | 6/1936 | Bedilion | 164/493 |
| 2,120,223 | 6/1938 | Wyatt | 164/493 |
| 2,579,898 | 12/1951 | Brucker | 164/338.1 X |
| 2,850,778 | 9/1958 | Smith | 164/338.1 X |
| 2,870,497 | 1/1959 | Ehrlich | 249/135 X |
| 2,892,224 | 6/1959 | Bauer | 164/338.1 |
| 3,432,642 | 3/1969 | Löhr | 165/104.19 |
| 3,709,459 | 1/1973 | Bushrod | 164/338.1 X |
| 3,815,659 | 6/1974 | Paulo | 164/338.1 X |
| 4,079,911 | 3/1978 | Wirtz | 164/338.1 X |

FOREIGN PATENT DOCUMENTS

| | | | |
|---|---|---|---|
| 56-59566 | 5/1981 | Japan | 164/DIG. 1 |
| 178605 | 3/1962 | Sweden | 164/50 |
| 320341 | 11/1971 | U.S.S.R. | 164/498 |
| 416396 | 7/1974 | U.S.S.R. | 164/498 |
| 293430 | 12/1976 | U.S.S.R. | 164/48 |

OTHER PUBLICATIONS

"Heat Exchange Fluids and Techniques", by M. W. Ranny; Pub: Noyes Data Corp.; Park Ridge, NJ.

"Glossary of Chemical Terms", by Hampel; Van Nostrand Reinhold Publisher.

*Primary Examiner*—Richard K. Seidel

*Attorney, Agent, or Firm*—Weiser & Stapler

[57] ABSTRACT

In accordance with a new method of casting electrode grids for electric lead storage batteries in a mold, premature solidifying of the melt is prevented before the end of the mold filling period by an additional heating pulse applied to the melt during the mold filling process, as well as by the use of a good heat conducting mold material. The cooling down to the unmolding temperature is also accelerated. Because of the short dwell time of the lead within the mold, there simultaneously results a short machine cycling period. The separate pulse heating of the melt is preferably carried out by an induction heating apparatus, the alternating field of the inductor located within the mold walls producing heat through eddy current production within the molten molded body.

9 Claims, 2 Drawing Sheets

CASTING TECHNIQUE FOR LEAD STORAGE BATTERY GRIDS

Figure 1:
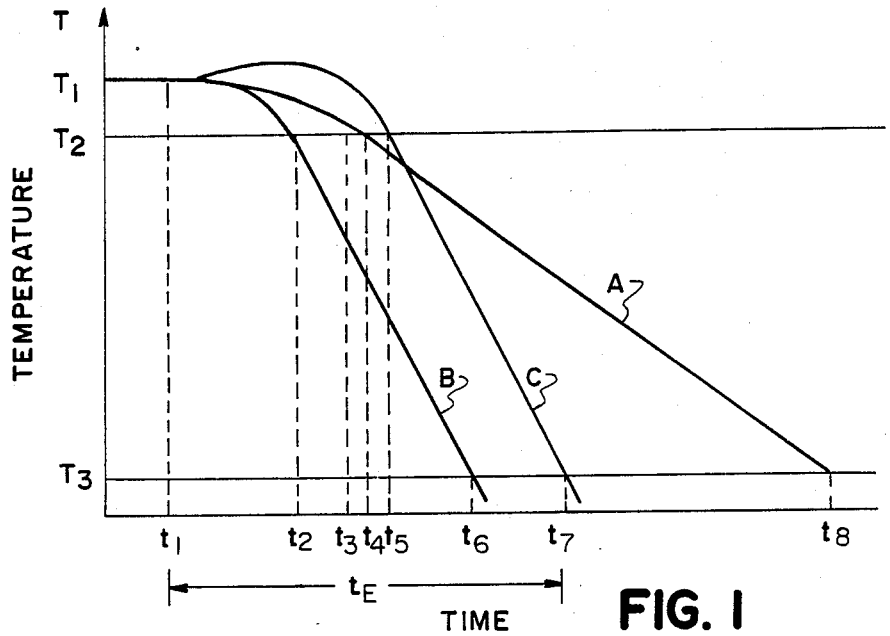

This application is a continuation, of application Ser. No. 487,906, filed 4-22-83 now abandoned.

The invention relates to a method of casting electrode grids for electric lead storage batteries within a casting mold as well as to apparatus for practicing this method.

In the past, the technology of grid casting has met the requirement for timely work progress during the manufacture of the storage batteries, mainly through introduction of more efficient multiple-grid casting machines, automation of the operating processes, or improvement of the tooling. The method, as such, has remained essentially unchanged. An extensive description is found, for example, in P. J. Moll, "Die Fabrikation von Blei-Akkumulatoren" (English translation: "The Manufacture of Lead Storage Batteries"), second edition, Akademische Verlagsgesellschaft (English translation: Academic Publishers), Geest & Portig KG, Leipzig 1952, pages 278 et seq. According thereto, lead storage battery grids, and particularly those for lead starter batteries, are produced in openable grid casting molds, into which the liquid lead alloy generally flows pressure-free from the melt reservoir. Because of the relatively low heat content of the thin starter grids, it is customary to provide mold heaters which prevent too rapid heat loss. On the other hand, provision must also be made for cooling the casting molds, if overheating created by continuous operation—with consequent longer cooling periods before solidification of the lead—is to be counteracted. For this purpose, the casting molds are provided with channels through which cooling water can flow.

Special care needs to be taken in the surface treatment of the grid mold, because the cast body must not adhere to its walls and must be easily unmolded. The application of a thermal protective layer to the mold surface previously took place through powdering with talcum or other mold powders, whereby there was also achieved good "running" of the melt. The powder is ordinarily used up after one work shift (3,000 to 5,000 castings) and must be renewed after cleaning of the casting mold. In addition to powder there has also been found suitable for the pretreatment of the casting mold a slurry of ground cork and waterglass which is atomized by means of a spray gun (see C. Drotschmann "Blei-Akkumulatoren", Verlag Chemie GmbH (English translation: "Lead Storage Batteries", Publisher Chemistry Company), Weinheim/BergstraBe, 1951, pages 113 et seq). The thinner the layer, the greater the strength of the ground cork coating. The ground cork treatment is the method which is currently preferentially used.

However, in the state of the art which has been indicated only generally in the above, certain defects in the casting procedure have heretofore not been overcome:

On the one hand, during the filling of the mold the ground cork layer causes a heat accumulation which prevents the melt from solidifying prematurely, considering the low heat capacity of the lead, before the mold is completely filled; the ground cork further provides an open passage for the displaced air along the walls of the mold and facilitates the unmoldability of the casting.

On the other hand, this very heat insulation effect of the ground cork coating is undesirable when quick solidification is desired in order to shorten the manufacturing time. It also appears desirable to eliminate the everrecurring cleaning of the molds (removal of the entire coating) and the subsequent reconstruction of the ground cork layer, as well as the occasionally necessary after-spraying of the coating at points which have been mechanically damaged.

This can be achieved, for example, by the use of ceramic mold material which, despite porosity which is adequate for the air passage, has a lesser heat insulating effect than the ground cork layer. This makes it necessary either to raise the temperature of the melt or to raise the mold temperature substantially in order to ensure filling of the mold. Extended cycling time results. If it is desired to maintain short cycling time, or even to further shorten it in order to achieve higher yields, complete mold filling cannot be achieved without doing something more.

Accordingly, the present invention has the object of shortening the cycling time of the grid casting, to reduce the heat impedance, and to accelerate the heat removal from the melt in the sense of a greater heat gradient, while reliable filling of the mold must continue to be achieved. In addition, the inconvenient mold pretreatment by spraying is eliminated and the useful life of the mold is extended. Moreover, through the shortening of the solidification time there is to be achieved an improvement in casting quality through further refining of the crystalline structure even with a less costly alloy.

These and other objects which will appear are accomplished in accordance with the present invention by at least partially compensating for the heat which is lost from the melt through heat conduction during the filling process by means of an additional heat pulse.

Figure 2:
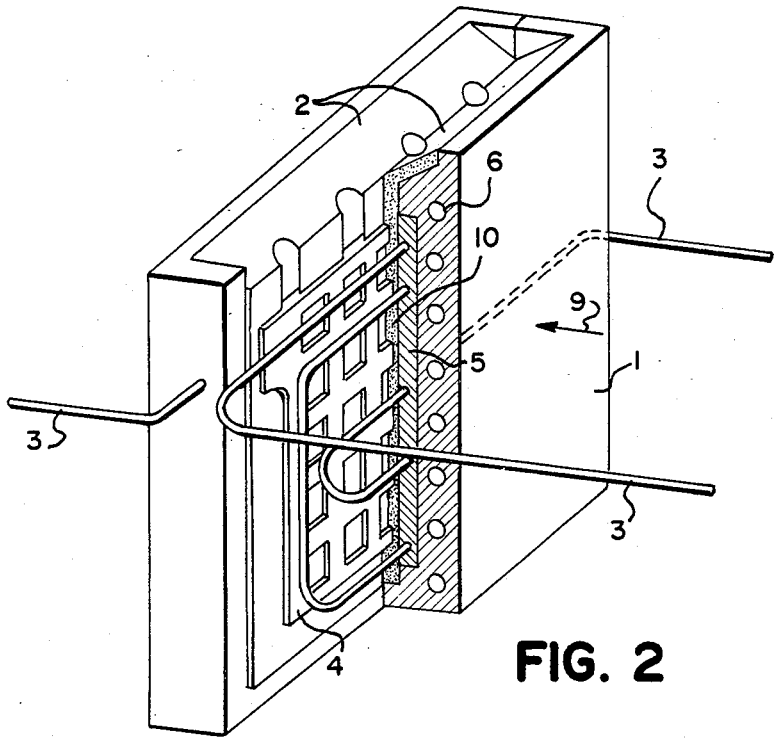

The manner of performing the method embodying the invention and an apparatus for its practice are further described in what follows, with reference to the accompanying illustrations, wherein:

FIG. 1 diagrammatically illustrates the cooling process of the castings under the conventional and the inventive casting conditions; and FIG. 2 shows a grid casting mold which is equipped with a heating apparatus embodying the invention.

Figure 3:
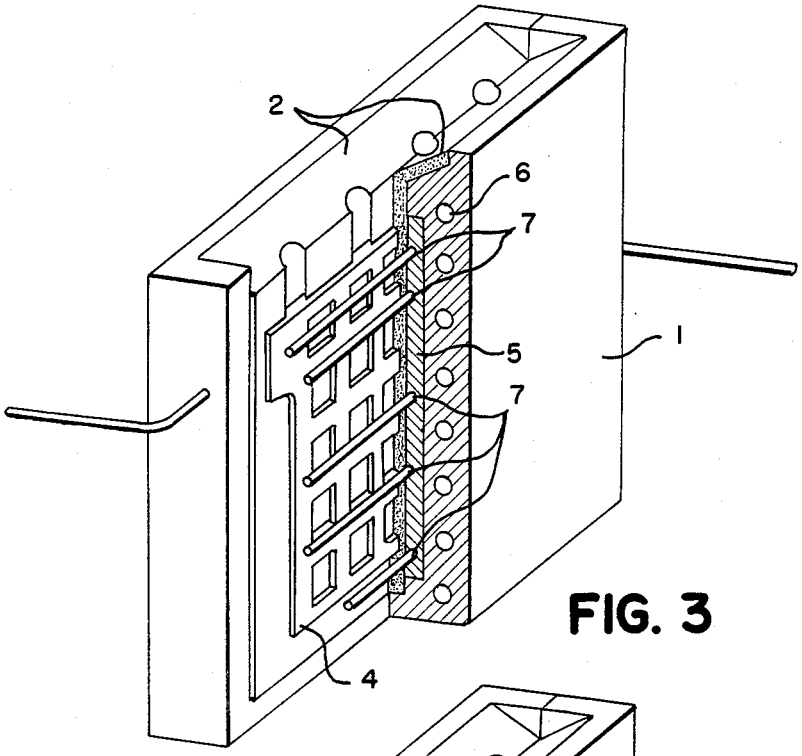
Figure 4:
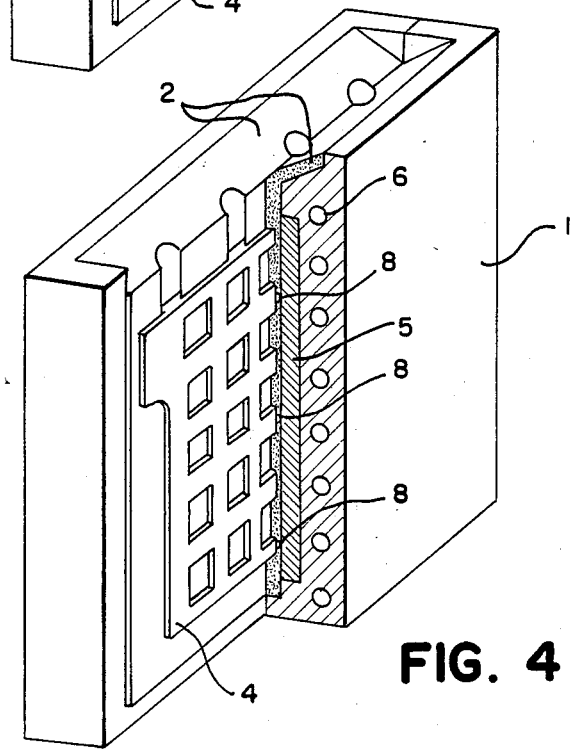

FIGS. 3 and 4 show grid casting molds which are equipped with alternative heating apparatus embodiments in accordance with the present invention.

In FIG. 1 there is shown the change in temperature T of the melt over the period t. The introduction of the lead melt into the casting mold takes place at $t_1$ and ends at time $t_3$, the inflow temperature being $T_1$. Cooling already starts even before the mold is completely filled, but the cooling rate is slow due to the low heat conductivity of the ground cork layer, so that the solidification point $T_2$ of the melt is reached only after a longer time interval—time $t_4$—and at $t_8$ there is finally reached the unmolding temperature $T_3$ of the casting (curve A). Thus there ensues a long cycling time ($t_8$–$t_1$), here so called for simplicity, although precisely speaking it includes only the dwell time of the lead in the form, or the period during which the form is closed. The actual machine cycling time is obtained by adding the time for opening the form, the open period, and the time for closing of the form, but these are all very short. If one were to insure, solely through intensive cooling or other improved heat removal measures, that the lead melt would already solidify at time $t_2$ so that the cycling time would end with unmolding at time $t_6$, then the danger would arise that the casting mold would not be completely filled, or that, when $T_1$ and $T_2$ differ only slightly from each other, there would not occur complete homogenization of the melt within the short time span $t_3-t_1$. This is because varying mold wall temperatures, for example, may create premature depositions which plug up individual gates of the mold, leading to local defects in the grid (curve B).

In accordance with the invention, this short but critical cooling phase is dealt with by stopping the heat outflow within the form during the filling thereof by means of a targeted heat pulse applied to the melt, whereby heat accumulation can even cause a slight rise in temperature. As soon as the mold is filled, the heat supply is stopped and the cooling effect of the cooling ducts built into the mold paths becomes fully effective, so that a cooling curve C embodying the present invention and extending parallel to cooling curve B is provided. It intersects the temperature lines $T_2$ (solidification temperature) and $T_3$ (unmolding temperature) at $t_5$ and $t_7$, respectively. The cycling time is thereby reduced to the time interval $t_E=t_7-t_1$.

By this temperature regime according to the present invention a discrete heating pulse is, so to speak, modulated onto the periodic heating which works in step with the cycling of the grid casting machine, the strength of the heating pulse having to take into account the heat conductivity of the casting mold. The lost heat which flows out of the melt in a casting mold with high heat impedance may sometimes need to be only partially compensated, whereas for a casting mold which has high heat conductivity it must be completely compensated or even overcompensated. Simultaneously, the technique embodying the invention also makes possible a shortening of the cycling time and with it more rapid operation, which also has a desirable effect upon the end product because an alloy grid with a very fine grained molecular structure results.

A further advantage of the method embodying the invention is that the casting temperature $T_1$ can be held relatively low, at a small distance from the solidification temperature $T_2$, because the heat application during the filling process of the melt keeps it with sufficient reliability out of the range in which there is danger of solidification or reduced viscosity. The melting point of a lead antimony alloy with 5% Sb, for example, is 291° C. The casting temperature can then be about 300° C. This reduction in casting temperature makes possible an energy saving and, in addition, the melt also has reduced susceptibility to the formation of a gray oxide, also known as "slag lead", such as ordinarily forms during the melting of compact lead in air.

The application of an additional heat pulse in accordance with the invention can be employed not only for conventional grid casting arrangements, but can also serve to assist the casting of grid tapes in a continuous process by means of a drum casting machine, where it is also desirable to achieve very short solidification periods. Here it has been found that the manufacture of fully formed grid tapes by conventional methods creates great difficulties and, in particular, permits only a narrow range of suitable alloys.

According to FIG. 2, apparatus which is suitable for the practice of the method embodying the invention consists of a split casting mold which is particularly advantageously equipped with an induction heating system for heating the melt. Preferably, the casting mold is made of a metal mold carrier 1 which has an insert of the appropriate mold cavities 2. This actual mold can consist of a ceramic material, e.g. according to French Patent No. 2,069,572 of silicon nitride, through which better heat removal is provided than through ground cork. At the outer surface of the mold half, there are mounted the copper windings of an inductor 3 which produces an alternating magnetic field that penetrates the lead grid 4 and creates heat inside the liquid grid through eddy current formation. The inductor is also connected to external induction heating apparatus. To improve the effectiveness of the inductor, its copper conductors, which are here in the form of pancake coils, are surrounded with magnetic field directing materials such as transformer laminations or high-frequency iron 5. The inductor can also be built up with a zig-zag conductor pattern. The conductors are made of copper tubes so that they can remove their own heating current losses as well as the heat which emanates from the lead grid.

The apparatus embodying the invention is completed by an efficient dual cooling system. In the cross-sectional view of the right hand mold carrier 1 this is indicated by the cross-sectional apertures 6 of numerous cooling channels. Heat removal through the metallic mold carrier material, e.g. cast iron, is effectively assisted by the cooling system. When differential heating of the lead melt takes place, it may sometimes be desirable to follow this by finely distributed cooling, because the heat conduction and the electrical conduction go hand in hand, not only within the melt itself, but also within the structural materials of the mold.

In lieu of inductive heating, resistance heating can also provide the technological means for temperature control of the casting process in accordance with the invention following cooling curve C in FIG. 1.

In accordance with the invention, and with reference to FIG. 3, resistance heating elements 7 in the form of wire or heating tubes can be inserted into the ceramic material of the mold body, preferably close beneath its surface and at the locations of the highest heat requirements. Because of the relatively good heat conductivity of the ceramic mold, the heat which is produced by the resistance elements when those are connected to an external current source is delivered quickly and efficiently to the inflowing lead. The mold heated in this manner promotes its complete filling with liquid lead. As soon as the mold has been filled, the resistance heating is turned off and the cooling effect of the cooling system provides for rapid solidification and cooling of the lead grid.

In accordance with the invention, and with reference to FIG. 4, there also exists the possibility of positioning within the ceramic mold two or more contacts (only some of which have been shown in the drawing) of an external electric current source, which enable the flow of electrical current within the lead when contacted by the liquid lead flowing into the mold. Thereby, the additional heat is produced by electrical current heating within the lead grid itself. When the form is completely filled, the external current source is turned off, and the cooling effect of the cooling system takes place.

A third alternative is flame heating. In that case, the mold carrier is subjected to flames from outside; schematically represented in FIG. 1, at 9. The heat conduction is retarded due to the wall thickness of the cavity holder, but this can be taken into account by providing a suitable advance start and can be optimized by other configuration changes of the mold carrier.

Between the mold carrier and the mold cavity inserted therein, there rarely exists perfect surface contact, despite the most careful workmanship. Ordinarily the existence of a three-point contact of the ceramic insert creates an air gap between the cavity and the mold carrier which interferes substantially with the desired unimpeded transfer of heat. In accordance with the invention, these air gaps can be filled with a heat conducting medium, at 10. Suitable for such a medium is a chemically inert heat conductive oil, preferably a high boiling point paraffin oil, silicon oil, or silicon wax. The improvement in heat conduction between ceramic mold and the cooling medium traversed conductors of the inductor heating system can also be improved by use of such heat conducting oils.

I claim:

1. Method of casting electrode grids for electric lead storage batteries in a casting mold having casting surfaces provided with a porous, electrically poorly conducting or non-conducting coating, comprising the steps of:

providing a lead melt which has been heated prior to introduction to said casting mold;

filling said casting mold with said lead melt so that the casting surfaces of said mold are heated by the incoming melt; and at least partially compensating for heat flowing out of the lead melt during said filling by generating an additional heat pulse within the melt during said filling so that the lead melt is prevented from cooling below a temperature which would permit solidification of the lead melt before said filling is complete.

2. The method according to claim 1 wherein the heating is effected through induction heating.

3. The method according to claim 1 wherein the heating is effected through resistance heating.

4. The method according to claim 1 wherein the additional heating commences when the lead melt is introduced into the mold, and terminates when the mold is filled.

5. The method according to claim 4 wherein said method further comprises the step of cooling the mold after the heating is terminated.

6. The method according to claim 1 wherein the additional heating is proportioned in accordance with the heat conductivity of the mold.

7. The method of claim 1 wherein the additional heat pulse is applied directly to the lead melt.

8. The method of claim 7 wherein the additional heat pulse does not appreciably heat the casting mold.

9. Method for casting electrode grids for electric lead storage batteries in a mold which includes surfaces having a porous, electrically poorly conducting or non-conducting protective coating which offers minimal resistance to the passage of heat, comprising cyclically heating said mold by an incoming lead melt and cooling said mold together with said lead melt until the casting is unmolded, and at least partially compensating for heat passing by thermal conductivity out of the lead melt during filling of the mold by generating a deliberate pulse of heat within the lead melt so that the lead melt contained in the mold is prevented from cooling below solidification temperature before the mold has been filled.

* * * * *